US005551752A

United States Patent [19]

Lovegrove et al.

[11] Patent Number: 5,551,752

[45] Date of Patent: Sep. 3, 1996

[54] LUMBAR SUPPORT CUSHION FOR CHAIRS

[75] Inventors: Ross Lovegrove, London, England; Stephen Peart, Los Gatos, Calif.

[73] Assignee: Knoll, Inc., East Greenville, Pa.

[21] Appl. No.: 534,600

[22] Filed: Sep. 27, 1995

Related U.S. Application Data

[63] Continuation of Ser. No. 216,562, Mar. 22, 1994, abandoned.

[51] Int. Cl.[6] ..... A47C 3/025

[52] U.S. Cl. ..... 297/284.5; 297/284.4; 297/DIG. 1

[58] Field of Search ..... 297/284.1, 391, 297/397, DIG. 1, 284.6, 284.5, 284.4, 219.1

[56] References Cited

U.S. PATENT DOCUMENTS

| | | | |
|---|---|---|---|
| 2,591,306 | 4/1952 | Sherman | 297/284.5 |
| 2,708,475 | 5/1955 | Krewson | 297/284.5 X |
| 2,775,999 | 1/1957 | Goodeve | 297/284.5 X |
| 3,195,953 | 7/1965 | Zacks | 297/397 |
| 3,414,324 | 12/1968 | Taylor et al. | 297/397 X |
| 3,542,421 | 11/1970 | Ambrose | 297/284.1 X |
| 4,206,945 | 6/1980 | Kifferstein | 297/397 X |
| 5,027,589 | 7/1991 | Gleb et al. | 54/66 |
| 5,141,285 | 8/1992 | Park | 297/457 |
| 5,147,110 | 9/1992 | Syers | 297/397 |

*Primary Examiner*—Milton Nelson, Jr.
*Attorney, Agent, or Firm*—Buchanan Ingersoll, P.C.; Carla J. Vrsansky

[57] ABSTRACT

Disclosed is a cushion for supporting the lumbar area of the back of a person while seated in a chair. The cushion is suitable for use with different types of chairs and is comprised of an elongated strip of flexible material that drapes over the chair back and has a weight on one end thereof to allow easy adjustment of the cushion and a pad of foamed cushion material at the other end. The pad of foamed cushion material is adapted to fit between the chair back and the lumbar area of the back of the seated person and is preferably made of a heat sensitive plastic foam that will mold itself to conform to the shape of the lumbar area of the user's back from the body heat of the person seated in the chair.

5 Claims, 3 Drawing Sheets

LUMBAR SUPPORT CUSHION FOR CHAIRS

This application is a continuation of application Ser. No. 08/216,562 filed Mar. 22, 1994 and now abandoned.

BACKGROUND OF THE INVENTION

This invention relates to a cushion or pad for use with a chair to support the lumbar area of a person's back while seated in the chair. Many chairs, especially office chairs, are designed to accommodate a person of average size and build. As a result many people find even a well designed chair uncomfortable and tiring when the person sits in the chair all day, such as in an office. The problem is especially acute with secretaries, computer terminal operators and those that have chronic back problems. While some people have tried to alleviate the problem with loose pillow cushions or the like, these are easily dislodged by movement of the user especially when used with the typical two piece secretarial type chair where the chair seat and chair back are spaced from each other.

SUMMARY OF THE INVENTION

It is an object of this invention to provide a universal type of lumbar support cushion or pad suitable for use with most types of chairs that will comfortably support and cushion the lumbar region of the user.

It is another object of this invention to provide a universal type of lumbar support cushion or pad for a chair that can be easily adjusted and custom shaped by the user for maximum support and comfort.

It is another object of this invention to provide a universal type of lumbar support cushion or pad for a chair that is attractive and easily adapted for use with a variety of different types of chairs.

These and other objects of this invention can be attained by a cushion for supporting the lumbar area of a person while seated in a chair comprising an elongated strip of flexible material having a weight at one end thereof and a pad of foamed cushion material at the other end. The weighted end of the elongated strip of flexible material drapes over the top and rear of the chair back and holds the pad of foamed cushion material against the front of the chair back and against the lumbar area of the back of the user.

DESCRIPTION OF THE PREFERRED EMBODIMENTS

Figure 1:
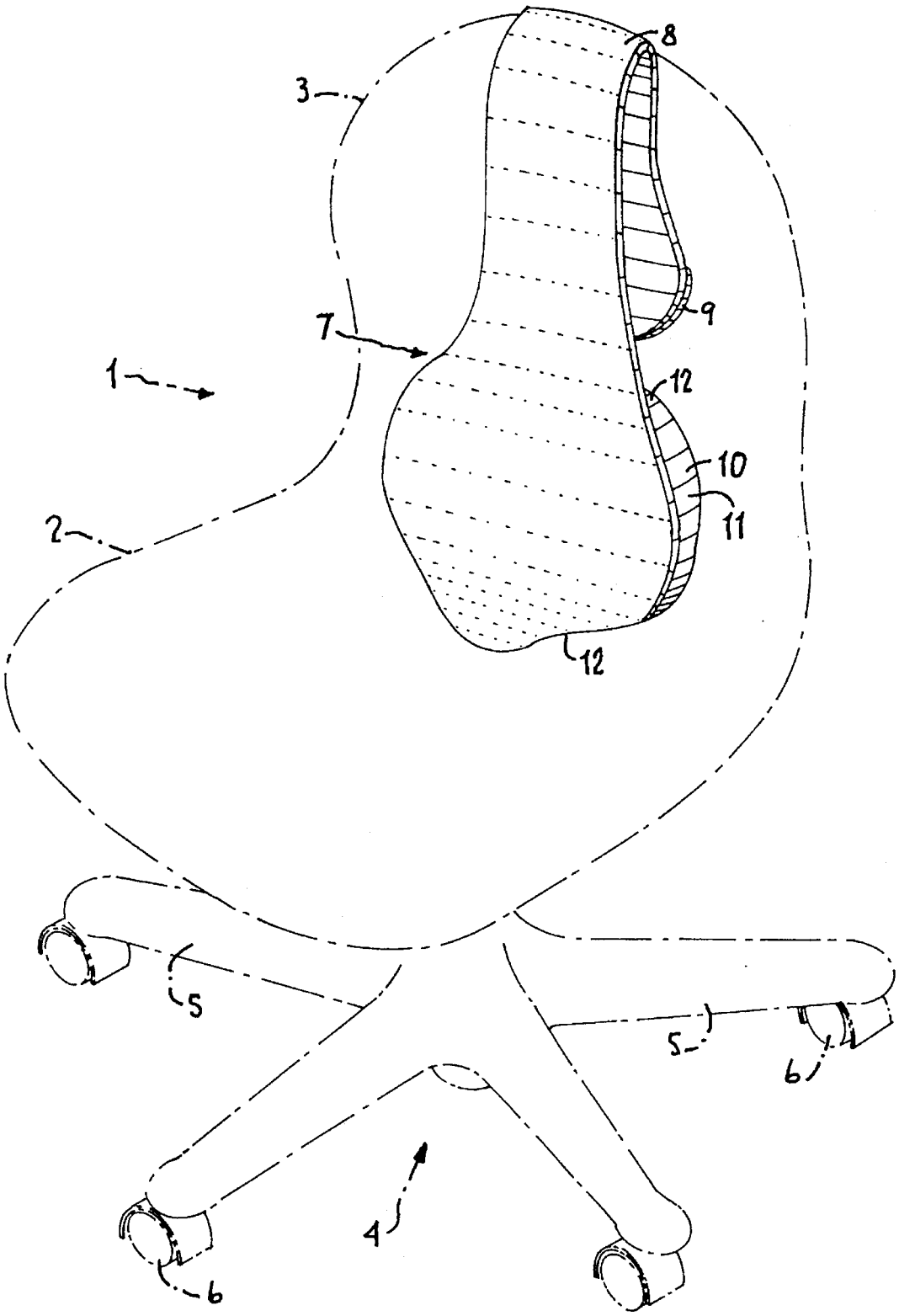
FIG. 1 is an isometric view of a typical office chair, shown in phantom, fitted with a lumbar support cushion of this invention.

FIG. 1 is an isometric view of a typical one piece office chair, shown in phantom, fitted with a lumbar support cushion of this invention. As shown in FIG. 1, the chair 1 is comprised of a padded and upholstered seat portion 2 and a padded and upholstered back portion 3 held in a rigid shell (not shown) and supported on a pedestal base 4 having a plurality of radial legs 5 and casters 6. The chair 1 is fitted with a lumbar support cushion 7 of this invention.

The lumbar support cushion 7 of this invention is comprised of an elongated strip 8 of flexible material having a weight 9 at one end thereof and a pad 10 of foamed cushion material at the other end. The end of the elongated strip 8 having the pad 10 is adapted to fit between the lumbar area of the back of the seated person and the front surface of the back 3 portion of the chair 1. The end of the elongated strip 8 having the weight 9 is adapted to drape over the top of the chair back portion 3 so that the end of the elongated strip 8 with weight 9 hangs freely suspended from the top of the chair back portion 3, as illustrated in FIG. 1. It will be apparent that such an arrangement allows the user to easily move and adjust the lumbar support cushion 7 to a position of maximum comfort to the user but the friction of the elongated strip of flexible material 8 on the chair back portion 3 and the weight 9 will hold the pad 10 of foamed cushion material in the desired position. Such an arrangement also allows the same lumbar support cushion 7 to be easily moved and used with chairs of different design and configuration.

In the preferred embodiment of this invention, the elongated strip 8 of flexible material is made of a closed cell neoprene rubber and nylon fabric flexible laminate material, about 0.25 inches (6.35 mm.) thick manufactured by Rubatex Corporation, Bedford, Va. However, the elongated strip 8 could also be made of any other flexible strip material, such as leather, plastic or a heavy woven fabric.

Figure 2:
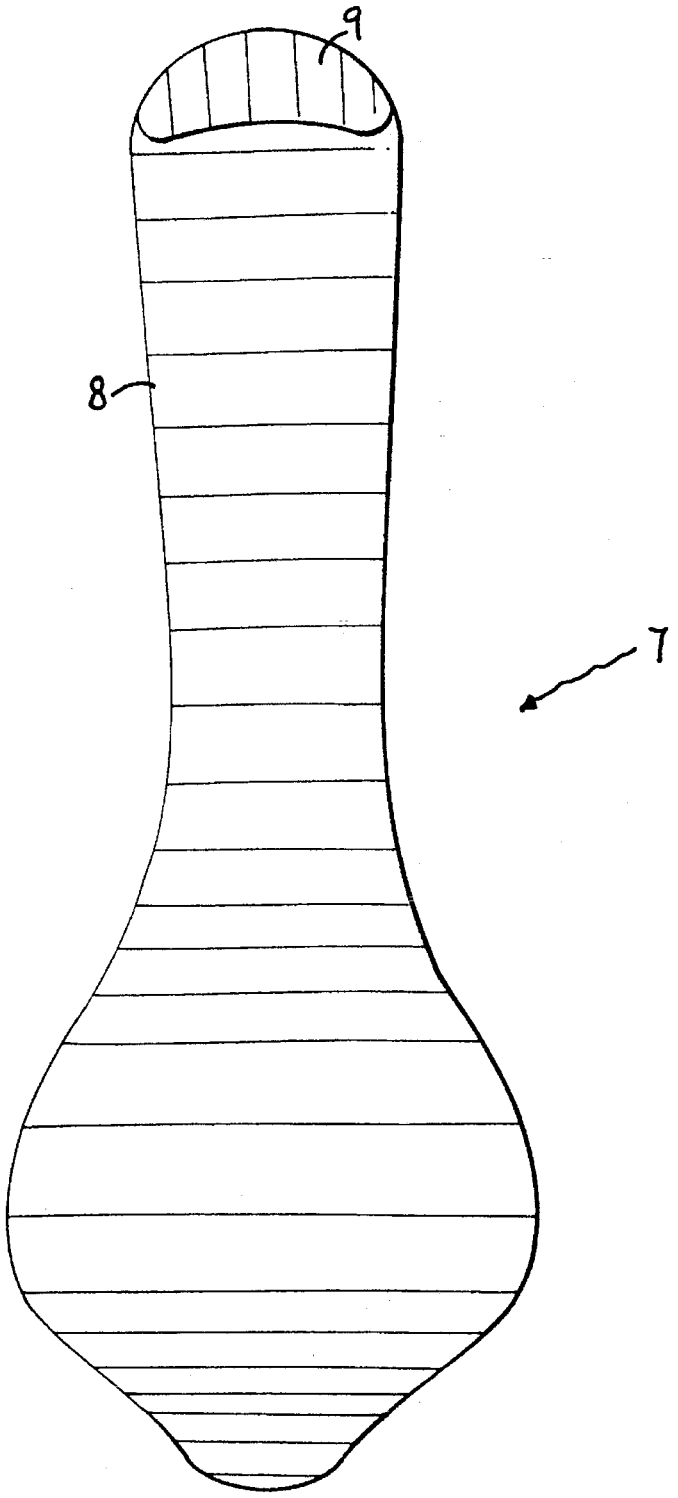
FIG. 2 is a front view of a preferred embodiment of the lumbar support cushion of this invention.
Figure 3:
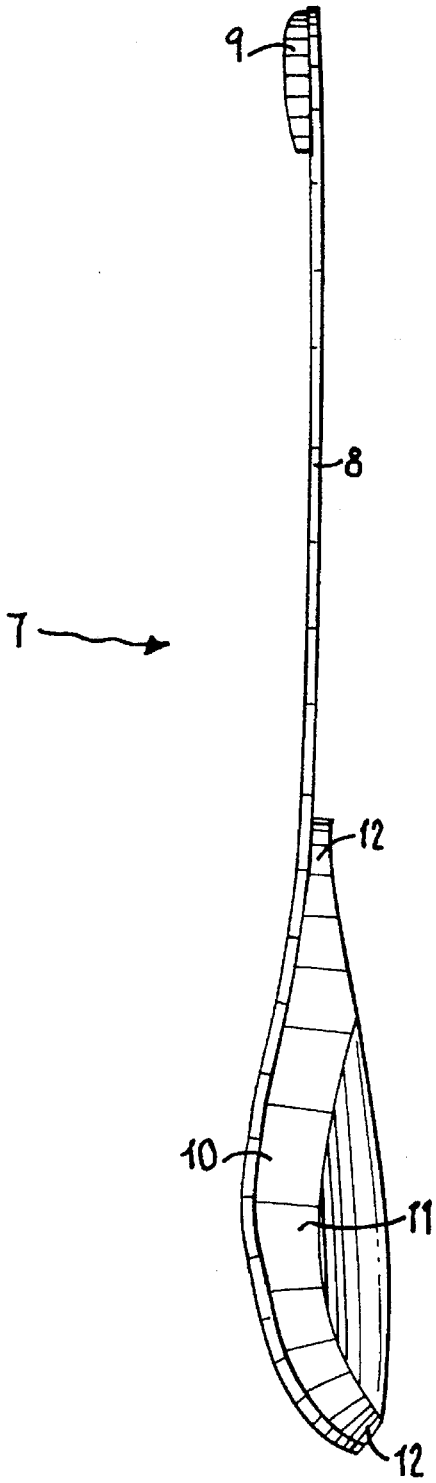
FIG. 3 is a side view of a preferred embodiment of the lumbar support cushion of this invention.

As shown in FIGS. 2 and 3, one end of the elongated strip 8 is provided with a weight 9, as described above. In the preferred embodiment, the weight 9 is a zinc casting shaped to conform to the shape of the end of the elongated strip 8 and bonded to the end of the elongated strip 8 with an adhesive or other suitable fastening means. However, the weight 9 could be made of another metal, such as iron or a suitable weight provided by a pocket formed in the elongated strip 8 filled with metal shot or other similar heavy material.

The other end of the elongated strip 8 in the preferred embodiment of this invention is provided with a pad 10 of a foamed cushion material bonded to the rear face of the elongated strip 8 with a suitable adhesive. As shown in FIGS. 2 and 3, the side portions 11 of the pad 10 in this embodiment are made thicker than the top and bottom portions 12 of the pad 10 to provide proper support for the lumbar area of the back of the user. In addition, in the preferred embodiment of this invention, the pad 10 is made of a heat sensitive open cell urethane foam of the type manufactured by EAR Concepts, Indianapolis, Ind. and sold under the trademarks "EMPERFOAM" and "CONFOR". This foam cushion material has the unique property of being sensitive to body heat which allows the pad 10 to deform and mold to the shape of the lumbar area of the user's back just from exposure to the body heat of the user. While this type of heat sensitive foam pad 10 is preferred to provide a custom fit for maximum comfort, it would be possible to use a pad 10 for this invention made from a foam that is not heat sensitive or able to be custom molded by body heat of the user.

As best illustrated in FIG. 2, the elongated strip 8 of flexible material is shaped so that the end portions are wider than the central portion and preferably made with curvilinear shaped ends to provide an aesthetically pleasing appearance for the lumbar support cushion 7.

It is believed the present invention and its advantages will be understood from the this description and the accompanying drawings and it will be apparent that changes may be made in the construction, form and arrangement of the lumbar support cushion of this invention as described and illustrated, without departing from the scope of this invention.

We claim:

1. A cushion for supporting the lumbar area of a person while seated in a chair having a back, the cushion comprising:

an elongated strip of material having two ends, a front face and a rear face;

a pad of foamed cushion material having a front longitudinal surface, a rear longitudinal surface, a top portion, a bottom portion and side portions;

the elongated strip of material having a discreet weight attached to the front face of the elongated strip of material at one end thereof and the pad of foamed cushion material attached to the rear face of the elongated strip of material at the other end thereof, the rear face of the elongated strip of material substantially covering the front longitudinal surface of the pad of foamed cushion material; and the pad of foamed cushion material adapted to fit between a seated person's lumbar area and the back of the chair.

2. The cushion according to claim 1 wherein the pad of foamed cushion material is constructed of a heat sensitive foam capable of being molded to conform to a person's lumbar area from the person's body heat.

3. The cushion according to claim 2 wherein the end of the elongated strip of material attached to the pad of foamed cushion material is wider than the end of the elongated strip of material attached to the weight.

4. The cushion according to claim 3 wherein the side portions of the pad of foamed cushion material are thicker than the top and bottom portions.

5. The cushion according to claim 4 wherein the front longitudinal surface of the pad of foamed cushion material is bonded to the rear face of the elongated strip of material.

* * * * *